US005488997A

United States Patent [19]

Yamada

[11] Patent Number: 5,488,997

[45] Date of Patent: Feb. 6, 1996

[54] ROTARY IMPACTING APPARATUS

[75] Inventor: Sakuji Yamada, Kobe, Japan

[73] Assignee: Yamada Juki Co., Ltd., Hyogo, Japan

[21] Appl. No.: 322,517

[22] Filed: Oct. 14, 1994

[30] Foreign Application Priority Data

Oct. 19, 1993 [JP] Japan ..... 5-261226

[51] Int. Cl.[6] ..... B25D 15/02

[52] U.S. Cl. ..... 173/15; 173/91; 173/94; 173/205; 173/128; 30/164.6

[58] Field of Search ..... 173/13, 15, 49, 173/91, 94, 128, 205; 404/133.05, 133.2; 30/164.6, 167

[56] References Cited

U.S. PATENT DOCUMENTS 2,226,559 12/1940 Groom ..... 173/94
3,160,217 12/1964 Raihle ..... 173/94
3,162,252 12/1964 Cobi ..... 173/205 X
4,495,791 1/1985 Kemnitz et al. ..... 72/453.02
5,002,134 3/1991 Yamada ..... 173/94

FOREIGN PATENT DOCUMENTS 0076768 4/1983 European Pat. Off. .

*Primary Examiner*—Rinaldi I. Rada
*Assistant Examiner*—Jay A. Stelacone
*Attorney, Agent, or Firm*—Michael D. Bednarek; Marks & Murase

[57] ABSTRACT

A rotary impacting apparatus comprises a housing, a rotor rotated in the housing, an impact member eccentrically held by the rotor, and a main reciprocative implement held reciprocatively at a forward end portion of the housing. The rotor rotates to hit the impact member for driving the main reciprocative implement into the ground for instance. The apparatus further includes an auxiliary oscillating mechanism for transmitting an impacting force from the impact member to pull the main reciprocative implement when the housing is pulled relative to the main reciprocative implement by a predetermined distance.

8 Claims, 17 Drawing Sheets

ROTARY IMPACTING APPARATUS

BACKGROUND OF THE INVENTION

1. Field of the Invention

The present invention relates to a rotary impacting apparatus, and more specifically to a rotary impacting apparatus suitable to such tasks as underground root cutting or plant cutting above the ground.

2. Description of the Related Arts

Generally, the impacting apparatus represented for instance by a concrete breaker utilizes expansive force of compressed air or a combination of a prime motor and a crank mechanism for forcibly reciprocating an impacting piston in the main body. When reciprocated, the impacting piston repetitively hits a reciprocating implement supported at an end portion of the main body in an axial direction.

Recently, however, a new type of impacting apparatus differing from the reciprocating type described hereinabove has been introduced. This type, called "rotary impacting apparatus", is developed for decreasing the reaction of the impact and increasing the impacting frequency. The basic constitution of the rotary impacting apparatus is disclosed, for instance, in the U.S. Pat. No. 5,002,134.

The apparatus disclosed in the above United States Patent comprises a housing in which a rotor is driven by a drive source, and an impact member of a predetermined mass loosely and eccentrically held by the rotor. When the rotor rotates, the impact member repeatedly hits the top end of a reciprocative implement slidably supported by the housing, thereby driving the reciprocative implement.

When using the rotary impacting apparatus, the operator supports the apparatus by holding a grip portion of a handle with the forward end of the reciprocative implement held against the ground for instance. The drive source is then turned on to rotate the rotor for causing the impact member to repeatedly hit the top end of the reciprocating implement, thereby driving the reciprocative implement into the ground. At the lower end of the reciprocative implement, there is mounted or integrally formed a suitably shaped tool such as blade or shovel depending on the applications.

One of such applications is the removal of a tree from the ground for shipment. For reliably performing the removal which is followed by subsequent re-planting and growing thereof, the entire root system of the tree must be carefully trimmed about a year before the planned shipment. This root trimming procedure must be performed thoroughly so that no root branches are left untrimmed, and for this purpose it is necessary to drive the tip of the reciprocative implement down to 50 cm underground.

Another application is the harvesting of sugarcane. Sugarcane has a high sugar content in its base portion buried in the ground. Traditionally, the cutting or harvesting must be done entirely by hand using a special tool called a pick.

Still another application which invloves laborious plant cutting is the crop yielding high above the ground. Specifically, as shown in FIG. 16, harvesting of coconuts Ya is performed by operating a long pusher rod from the ground. Such coconut yielding is under an increasing demand recently for palm oil production.

As will be understood from the FIG. 16, some coconuts Ya grow behind thickly growing palm leaves. Thus, these coconuts Ya can only be harvested after the blocking palm leaves are cut away by a cutting blade 50*x* mounted at the forward end of the pusher rod 50.

The rotary impacting apparatus disclosed in the above United Sates Patent may be used for the root trimming or coconut harvesting. However, with this rotary impacting apparatus the impact member in the housing hits the reciprocative implement only in the advancing direction.

On the other hand when the reciprocative implement is pulled out of the ground, a great friction may act on the reciprocative implement due to the root system or a great ground pressure. As a result, the impacting apparatus cannot be pulled out by an ordinary pulling force exerted on the handle of the apparatus, making the job very difficult and inefficient.

This problem is particularly serious when the rotary impacting apparatus is used for the root trimming process. Specifically, the root system may develops so randomly beneath the tree trunk that once the cutting blade is driven into the ground and held firmly by the root system, it becomes extremely difficult to pull the blade. In addition, when the reciprocative implement is driven to a depth of 50 cm as required for the root trimming process, the ground pressure becomes too large for an ordinary operator to pull the blade out of the ground.

On the other hand when the coconut Ya is harvested (see FIG. 17), the cutting blade 50*x* is driven into the base portion Yc of the palm leaf Yb. However, it is usually difficult for a single driving action to make a complete cut, and the cutting blade 50*x* driven halfway into the base portion Yc of the palm leave Ya receives a force W corresponding substantially to the entire weight of the palm leaf. Thus, even if the cutting blade 50*x* is replaced by the reciprocative implement of the rotary impacting apparatus, there is still a problem of difficulty in pulling the reciprocative implement off the leaf base portion.

SUMMARY OF THE INVENTION

It is, therefore, an object of the present invention to provide an improved rotary impacting apparatus which is capable of facilitating driving and pulling a reciprocative implement.

According to the present invention, a rotary impacting apparatus comprises: a housing; a rotor rotated in the housing by a driving source; an impact member eccentrically held by the rotor; and a main reciprocative implement held reciprocatively at a forward end portion of the housing; the impact member exerting an impacting force for pressing the main reciprocative implement when the housing is advanced relative to the main reciprocative implement; wherein the rotary impacting apparatus further includes an auxiliary oscillating mechanism for transmitting an impacting force from the impact member to pull the main reciprocative implement when the housing is pulled relative to the main reciprocative implement by a predetermined distance.

With the above described arrangement, when the operator holds the apparatus and presses the tip of the main reciprocating implement onto the ground or a leaf, for example, in a normal root trimming or leaf cutting operation, the housing moves in the advancing direction relative to the main reciprocating implement. Then, the impact member rotating in the housing forwardly impacts the the main reciprocative implement to drive the main reciprocative implement into the ground or leaf with vibration.

On the other hand when the apparatus is pulled out of the ground or half-cut palm leaf, the main reciprocative implement may be subjected to a resistance to the movement. In this case, the main reciprocative implement remains at the same position, whereas the housing alone is pulled. When the housing is pulled relative to the main reciprocative implement by the predetermined distance, the auxiliary oscillating mechanism receives a pulling impact from the impact member for transmission to the main reciprocative implement arrested in the ground or by the leaf. At this time, since the housing moves in the direction to relatively pull the main reciprocative implement, the impact member does not hit the main reciprocative implement in the advancing direction.

As described above, the auxiliary oscillating mechanism not only allows the impact member to hit the main reciprocative implement in the normal driving operation, but also causes the pulling impact to be applied o the main reciprocating implement arrested in the ground or by the leaf in the pulling operation. Further, the main reciprocative implement also receives a pull exerted by the operator. Thus, it is possible to efficiently cut an underground root system or a plant leaf above the ground, and to pull out the main reciprocative implement very easily.

According to a preferred embodiment of the present invention, the auxiliary oscillating mechanism includes: an auxiliary reciprocative member reciprocatively held at a base end portion of the housing for receiving the impacting force from the impact member when the housing is pulled relative to the main reciprocative implement by the predetermined distance; an oscillation receiving member provided close to the auxiliary reciprocative member for engagement therewith when the housing is pulled relative to the main reciprocative implement by the predetermined distance; an oscillation imparting member for engagement with the main reciprocative implement when the housing is pulled relative to the main reciprocative implement by the predetermined distance; connecting means connecting the oscillation receiving member and the oscillation imparting member; and elastic means urging the oscillation receiving member away from the auxiliary reciprocative member.

The forward end of the main reciprocating implement may be provided with a cutting blade suitable for cutting an underground root system or a plant body portion above the ground level.

For harvesting coconuts, the drive source may be connected to the housing through an elongat pipe in which a rotary shaft extendes for transmitting the torque from the drive source to the rotor.

Other object, features and advantages of the present invention will become clear from the following description of preferred embodiments made with reference to the attached drawings.

DETAILED DESCRIPTION OF THE PREFERRED EMBODIMENTS

FIGS. 1 through 4 show a rotary impacting apparatus according to a first embodiment of the present invention.

Figure 1:
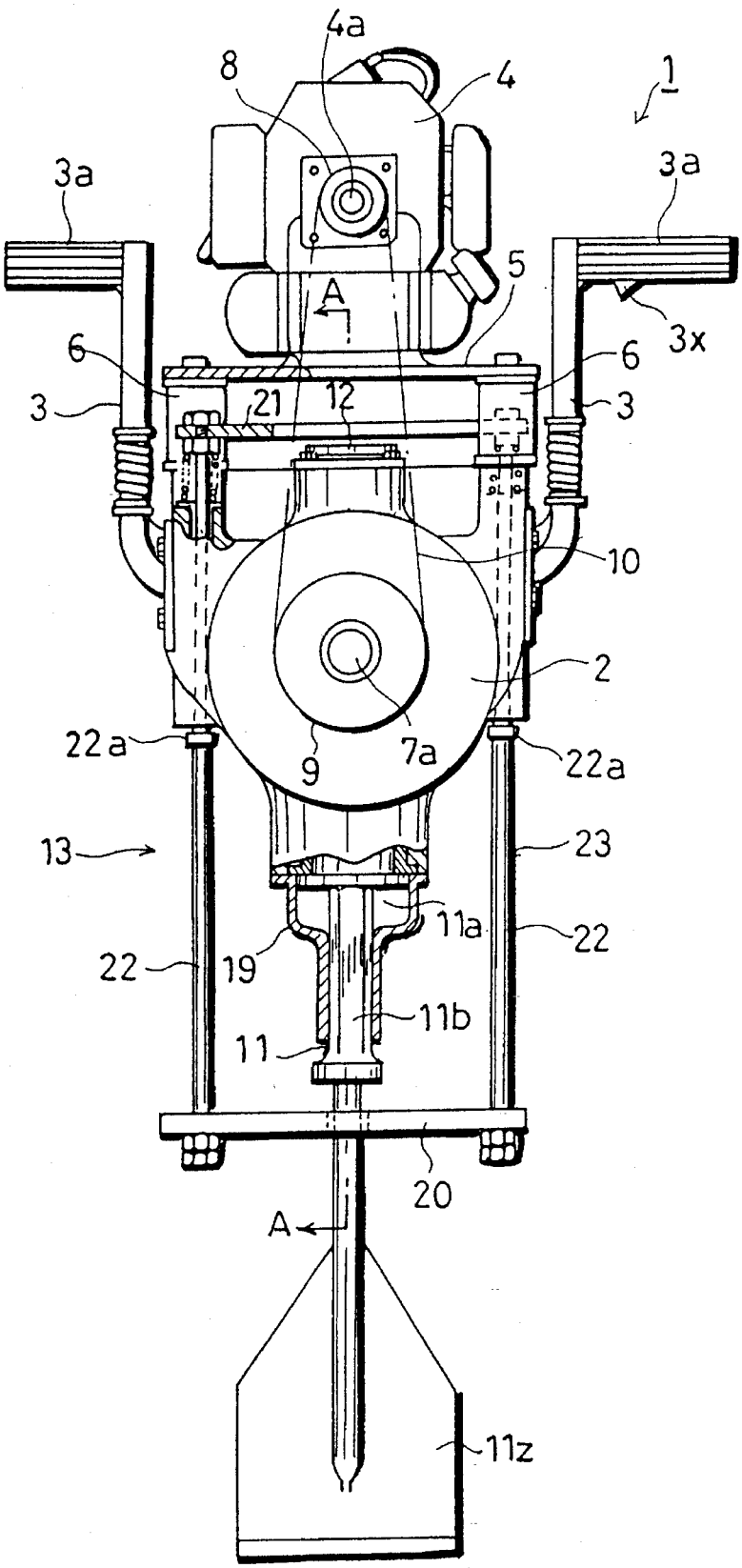
FIG. 1 is a front view, partially cut away, showing a rotary impacting apparatus according to a first embodiment of the present invention.

Referring first to FIG. 1, the rotary impacting apparatus 1 according to the first embodiment of the present invention includes a housing 2 which is flanked by a pair of handle arms 3 having respective grips 3*a*. An engine 4 as a drive source together with a mounting plate 5 is elastically supported above the housing 2 via vibration absorbing rubber pads 6. One of the grips 3*a* is provided with a throttle lever 3*x* for controlling the engine rotatation.

The housing 2 is provided, at its bottom end portion, with a main reciprocative implement 11 having a blade member 11*z* at its lower end. In this first embodiment, the blade member 11*z* is shaped suitably for root trimming. Further, in this first embodiment, a shank of the main reciprocative implement 11 is divided into first and second portions 11*a*, 11*b*. These two portions 11*a*, 11*b* may be formed integrally.

Figure 2:
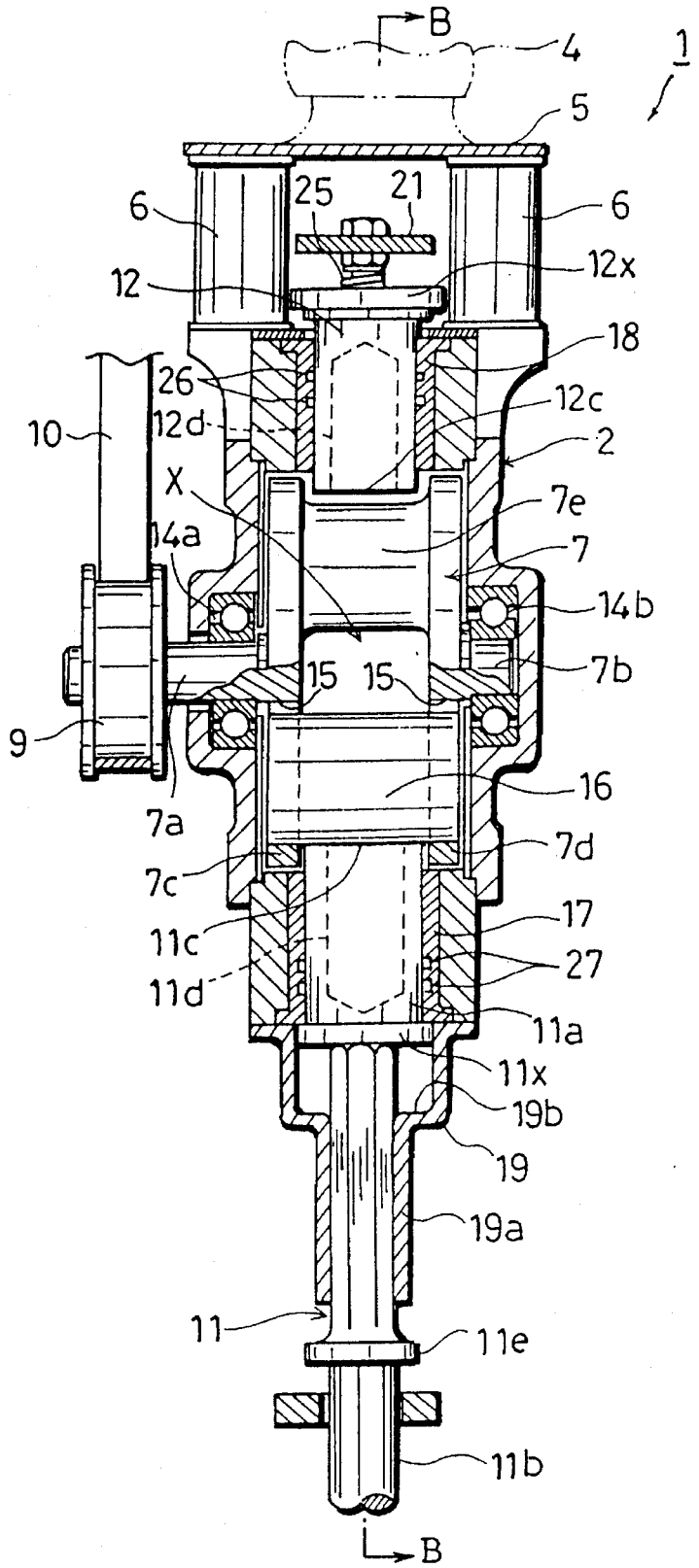
FIG. 2 is an enlarged side view in section taken along lines A—A in FIG. 1.
Figure 3:
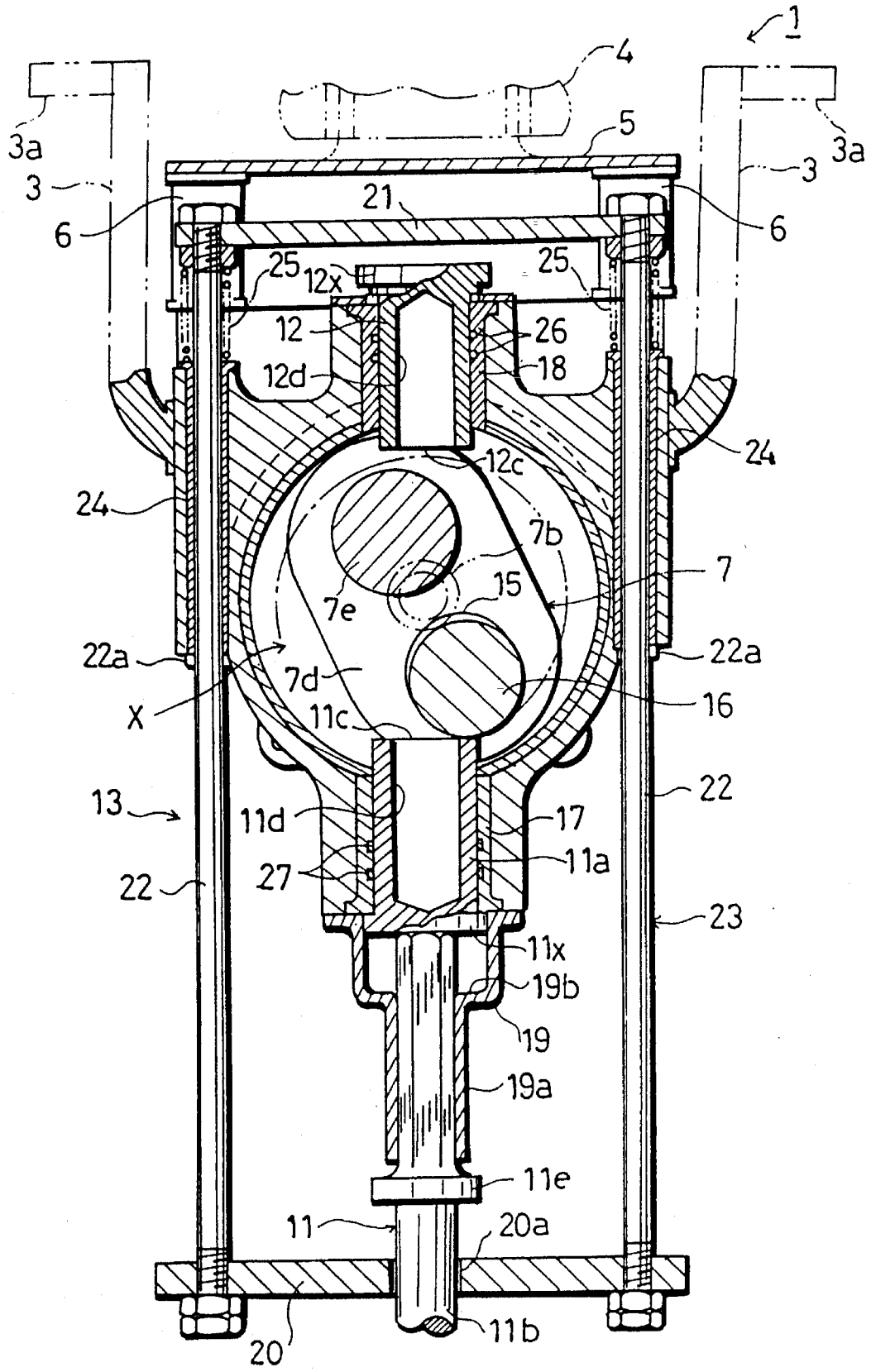
FIG. 3 is a front view in section taken along lines B—B in FIG. 2.
Figure 4:
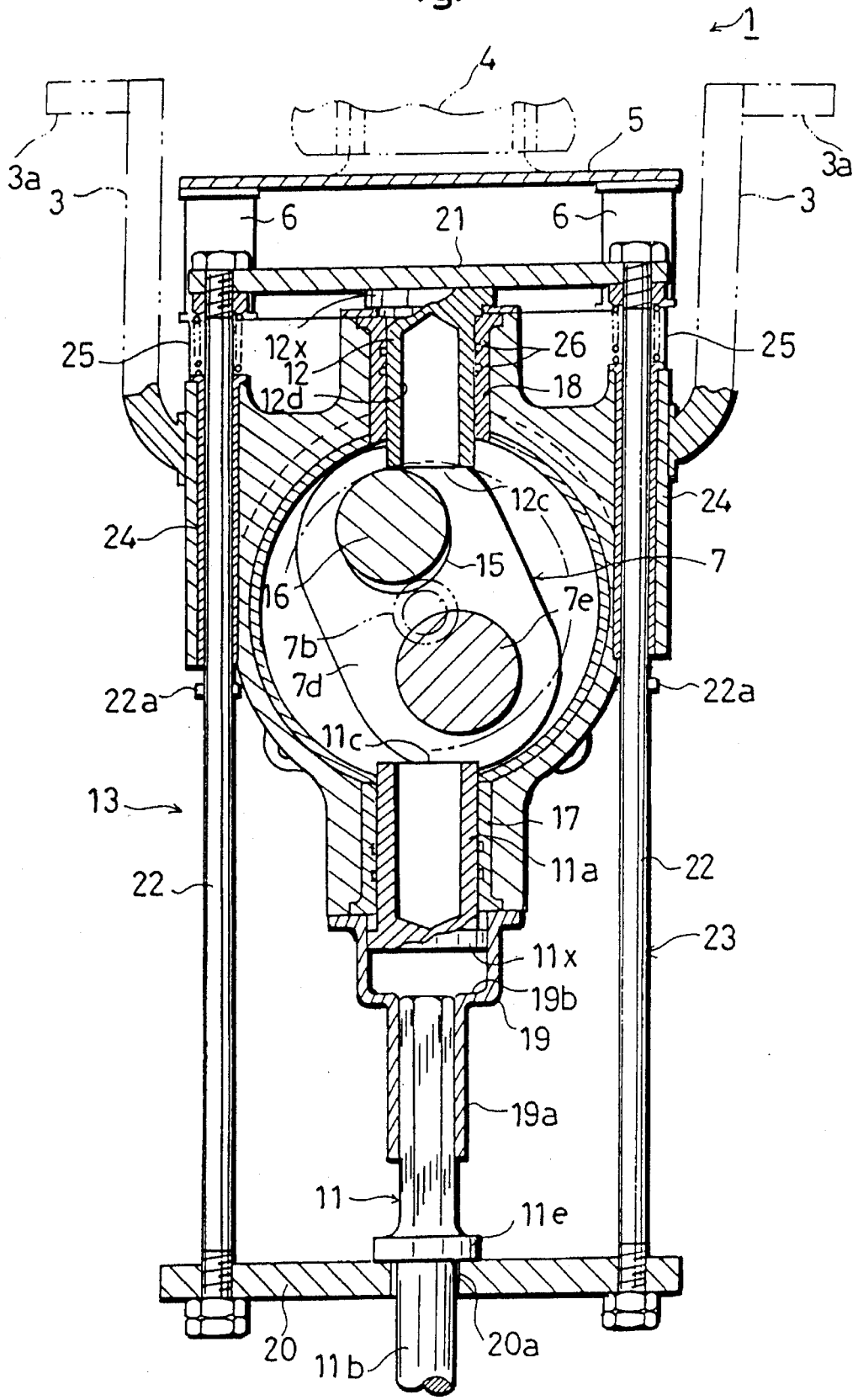
FIG. 4 is a sectional view similar to FIG. 3 but showing the rotary impact apparatus in the pulling operation.

As shown specifically in FIGS. 2 and 3, the housing 2 has a cylindrical inner space X for accommodating a rotor 7 rotated by the engine 4. This rotor 7 comprises a pair of flanges 7*c*, 7*d* integrated with but spaced from each other at a predetermined distance by a connector 7*e* functioning as a balancing weight. The flanges 7*c*, 7*d* is provided with respective rotary shafts 7*a*, 7*b* coaxial with each other. These rotary shafts 7*a*, 7*b* are rotatably supported by the side walls of the housing 2 via respective bearings 14*a*, 14*b*.

The engine 4 has an output shaft 4*a* carrying a drive wheel such as a pulley or a sprocket. A rotary shaft 7*a* of the rotor 7 carries with a driven wheel 9. These wheels 8 and 9 are connected by an endless transmission loop such as a belt or a chain for transmitting revolutions of the engine 4 to the rotor 7. A gear mechanism may be used as an alternative mechanism for transmitting the rotation of the engine 4 to the rotor 7.

Each of the flanges 7*c*, 7*d* is formed with an oval retaining hole 15 arranged diametrically opposite to the connector 7*e*. The retaining hole 15 loosely retains each end of a columnar impact member 16. The impact member 16 is rotatable in the retaining hole 15 and also movable radially within a limited range allowed by the retaining hole 15.

The lower and upper end portions of the housing 2 are respectively fitted with cylindrical sleeves 17, 18 respectively for slidably receiving the first portion 11*a* of the impact member 11 and an auxiliary reciprocative member 12. The first portion 11*a* of the impact member 16 and the auxiliary reciprocative member 12 are coaxial with each other, and have respective flat annular impact receiving faces 11*c*, 12*c* in parallel to each other.

The first portion 11*a* and the auxiliary reciprocative member 12 are respectively formed with buffer bores 11*d*, 12*d* opening at their impact receiving faces 11*c*, 12*c* and having a predetermined depth.

The lower end of the first portion 11*a* of the main reciprocative implement 11 and the upper end of the auxiliary reciprocative member are respectively formed with integral enlarged heads 11*x*, 12*x* abutting respectively the bottom and top ends of the housing 2, thereby limiting excessive inward movement of the first portion 11*a* and the auxiliary reciprocative member 12. A holder 19 is fixed below the housing 2. This holder 19 has a guide portion 19*a* for guiding axial movement of the second portion 11*b* of the main reciprocative implement 11, and a limit shoulder 19*b* for limiting excessive outward movement of the first portion 11*a* from the housing 2.

The apparatus 1 further includes an auxiliary oscillating mechanism 13 for transmitting an upper impacting force to the second portion 11*b* of the main reciprocative implement 11 under a predetermined condition. As shown in FIG. 3, the auxiliary oscillating mechanism 13 comprises, in addition to the auxiliary reciprocative member 12 provided above the housing 2, an oscillation imparting member 20 provided below the housing 2 for limiting downward movement of the second portion 11*b*, an oscillation receiving member 21 provided above the housing 2 for abutment with the enlarged head 12*x* of the auxiliary reciprocative member 12, and a pair of connecting rods 22 for connecting the oscillation imparting member 20 to the oscillation receiving member 21. The oscillation receiving member 21, oscillation imparting member 20 and connecting rods 22 together form a rectangular oscillation transmission frame 23.

The second portion 11*b* of the main reciprocative implement 11 is loosely inserted into an eye hole 20*a* formed in the oscillation imparting member 20 of the oscillation transmission frame 23. The second portion 11*b* is formed with a stopper flange 11*e* for abutment with a portion of the oscillation imparting member 20 around the eye hole 20*a*, thereby limiting the downward movement of the second portion 11*b*. Hence, the oscillation imparting member 20 functions to prevent the second portion 11*b* from dropping off in addition to transmitting oscillation.

Each of the connecting rods 22 of the oscillation transmission frame 23 is slidably inserted into a guide pipe 22 provided at a corresponding side of the housing 2. Between the oscillation receiving member 21 and the top end of housing 2, there is provided an elastic member 25 (such as compressed coil spring) wound around each of the connecting rods 22 for urging the oscillation transmission frame 23 against the housing 2. Each of the connecting rods 22 is fixedly provided with a stopper 22*a* for preventing the oscillation transmission frame 23 from being urged upward by the elastic member 25 beyond a predetermined position.

The impacting apparatus 1 having the above arrangement operates in the following manner.

When the apparatus is used for root trimming or digging, the operator supports the apparatus 1 downwardly by gripping the grips 3*a* of the handle arms to hold the blade member 11*z* of the main reciprocative implement 11 in pressing contact with the ground. As a result, the housing 2 moves downward due to its weight to bring the first portion 11*a* of the main reciprocative implement 11 to the uppermost position of its travel stroke as shown in FIG. 3. In this state, when the throttle lever 3*x* (See FIG. 1.) is operated to allow the engine 4 to turn at a high speed, an unillustrated centrifugal clutch activates to transmit rotational movement of the output shaft 4*a* of the engine 4 to the rotor 7 in the housing 2 via the endless transmission loop 10.

As a result, the impact member 16 hits the impact receiving face 11*c* of the first portion 11*a* upon each revolution of the rotor 7, thereby driving the main reciprocative implement 11 downward by an axial component of the impacting force and the centrifugal force acting on the impact member 16. At this time, the auxiliary reciprocative member 12 is held above its lowermost position because once the auxiliary reciprocative member 12 is hit up by the impact member 16, the auxiliary reciprocative member 12 is prohibited from moving down by friction from a set of O-rings 26 fitted in the sliding surface of the cylindrical sleeve 18. If necessary, a separate spring member may be added for holding the auxiliary reciprocative member 12 at a position not to be hit by the impact member 16. It should be noted here that there is another set of O-rings 27 provided in the cylindrical sleeve 17 slidably holding the first portion 11*a* of the main reciprocative implement 11.

On the other hand, two different operational modes are possible for removing the blade member 11*z* of the main reciprocative implement 11 from the ground by pulling the handle arms 3 of the apparatus 1. Specifically, if the main reciprocative implement 11 is under no or sufficiently small force preventing it from moving in the pulling direction, the oscillation receiving member 21 of the oscillation transmission frame 23 moves up with the housing 2 while being held apart from the enlarged head 12*x* of the auxiliary reciprocative member 12 by the urging force of the elastic member 25. In this condition, the second portion 11*b* of the main reciprocative implement 11 descends due to its own weight, and upon abutment of the stopper flange 11*e* with the oscillation imparting member 20 the impact member 16 is prevented from hitting the first portion 11*a*.

Conversely, if the main reciprocative implement 11 is under a relatively large force preventing it from moving in the pulling direction (for example, when the blade member 11*z* is caught by a random root network), the second portion of the main reciprocating implement 11 remains at the same position while the housing 2 is pulled upward. At this time, the auxiliary oscillation transmission mechanism 13 also ascends with the housing 2 to bring the oscillation imparting member 20 into engagement with the stopper flange 11*e* of the second portion 11*b* of the main reciprocative implement 11. As shown in FIG. 2, further assent of the housing 2 causes the oscillation receiving member 21 to press the enlarged head 12*x* of the auxiliary reciprocative member 12 against the urge of the elastic member 25, thereby moving the auxiliary reciprocative member 12 down to the lowermost position.

In this condition, the impact member 16 hits the impact receiving face 12*c* of the auxiliary reciprocative member 12 upon each revolution of the rotor 7, as shown in FIG. 2. As a result, an axial component of the impacting force combined with the centrifugal force acting on the impact member 16 repeatedly moves the auxiliary reciprocative implement 12 upwardly. This upward impacting force is transmitted through the oscillation transmission frame 23 to the second portion 11*b* of the main reciprocative implement 11. At this time, the impact member 16 does not hit the first portion 11*a* of the main reciprocative implement 11.

As described above, in addition to the pulling force exerted on the apparatus 1 by the operator, an upward pull caused by the impact member 16 acts repetitively on the second portion 11*b* of the main reciprocative implement. As a result, the blade member 11*z* caught in the ground can be easily pulled out of the ground by overcoming various resistances caused by the root system or other underground materials.

It should be noted here that the root cutting blade 11*z* mounted at the lower end of the main reciprocative implement 11 in the first embodiment may of course be replaced by a different type of blade such as a shovel blade.

FIGS. 5 through 9 show a rotary impacting apparatus according to a second embodiment of the present invention. FIG. 5 through 8 respectively correspond to FIGS. 1 through 4 of the first embodiment, and component members common to the first and second embodiments are referred to by the same reference numerals and characters as used in the first embodiment with no further description.

Figure 5:
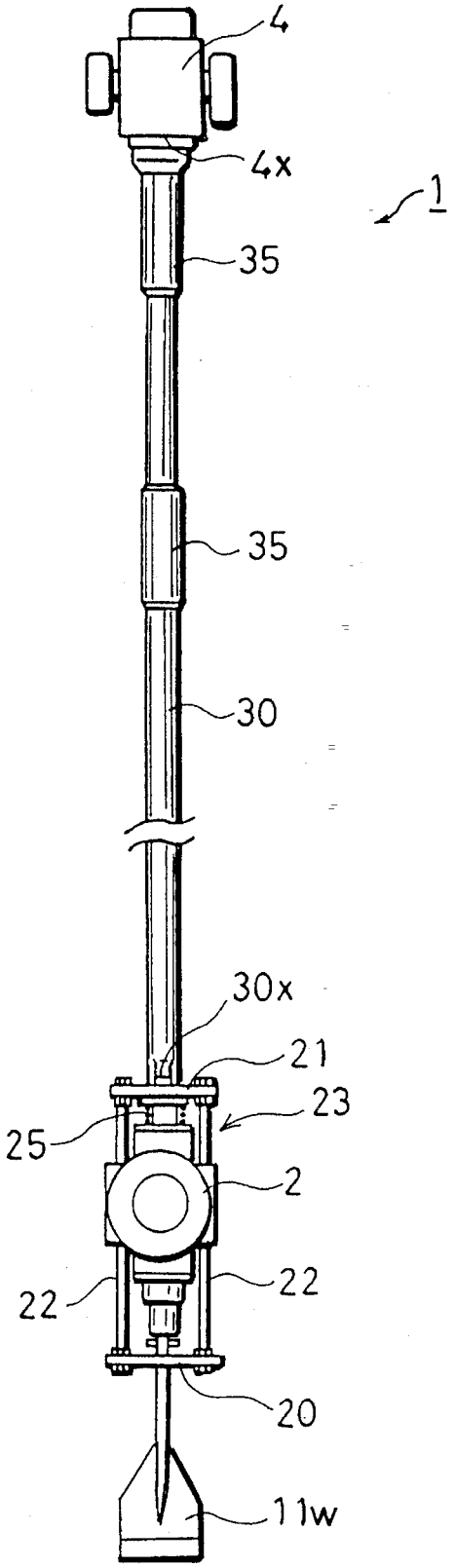
FIG. 5 is a front view showing a rotary impacting apparatus according to a second embodiment of the present invention.
Figure 6:
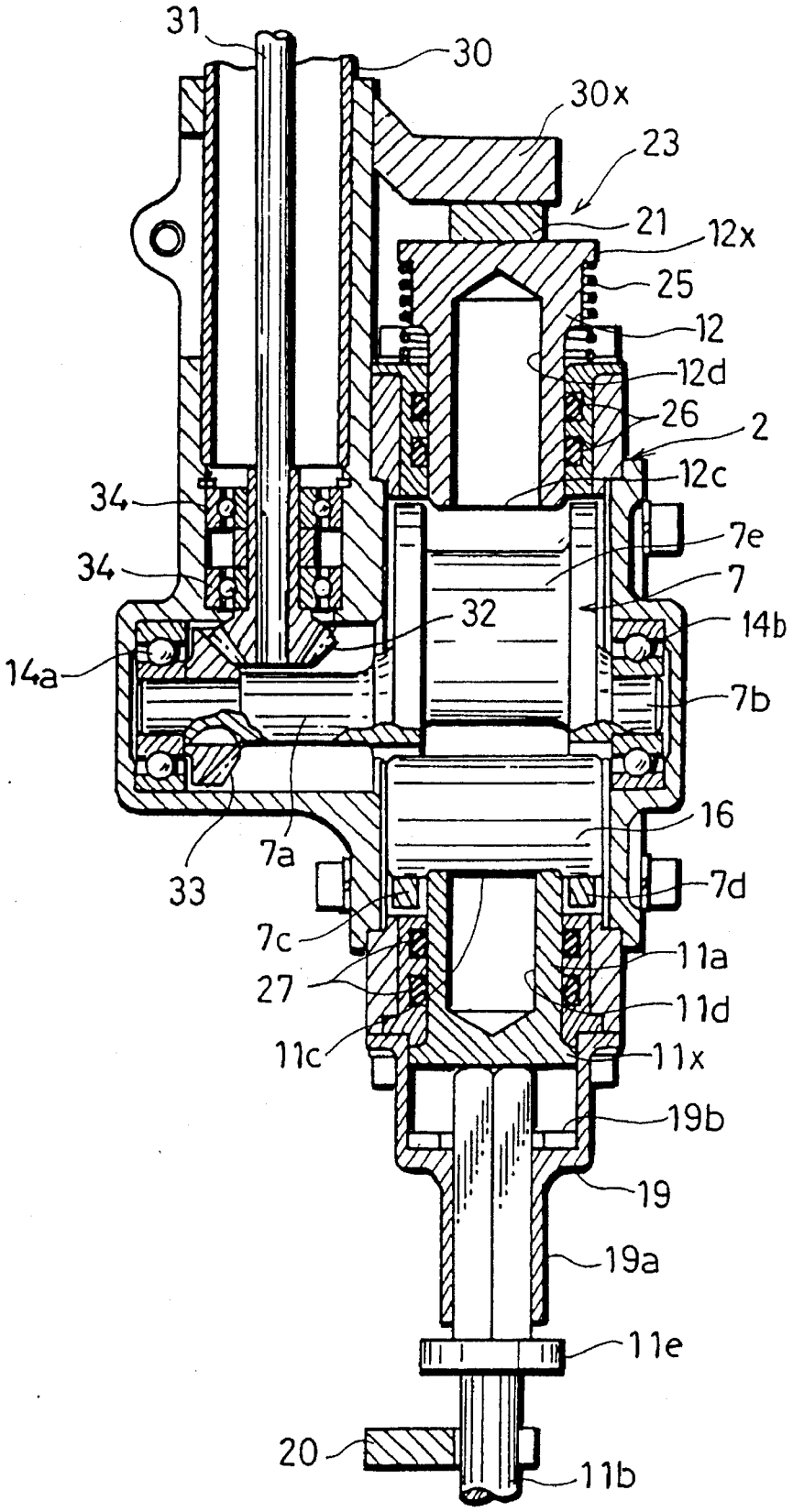
FIG. 6 is a sectional side view similar to FIG. 2 but showing the rotary impacting apparatus of the second embodiment.
Figure 7:
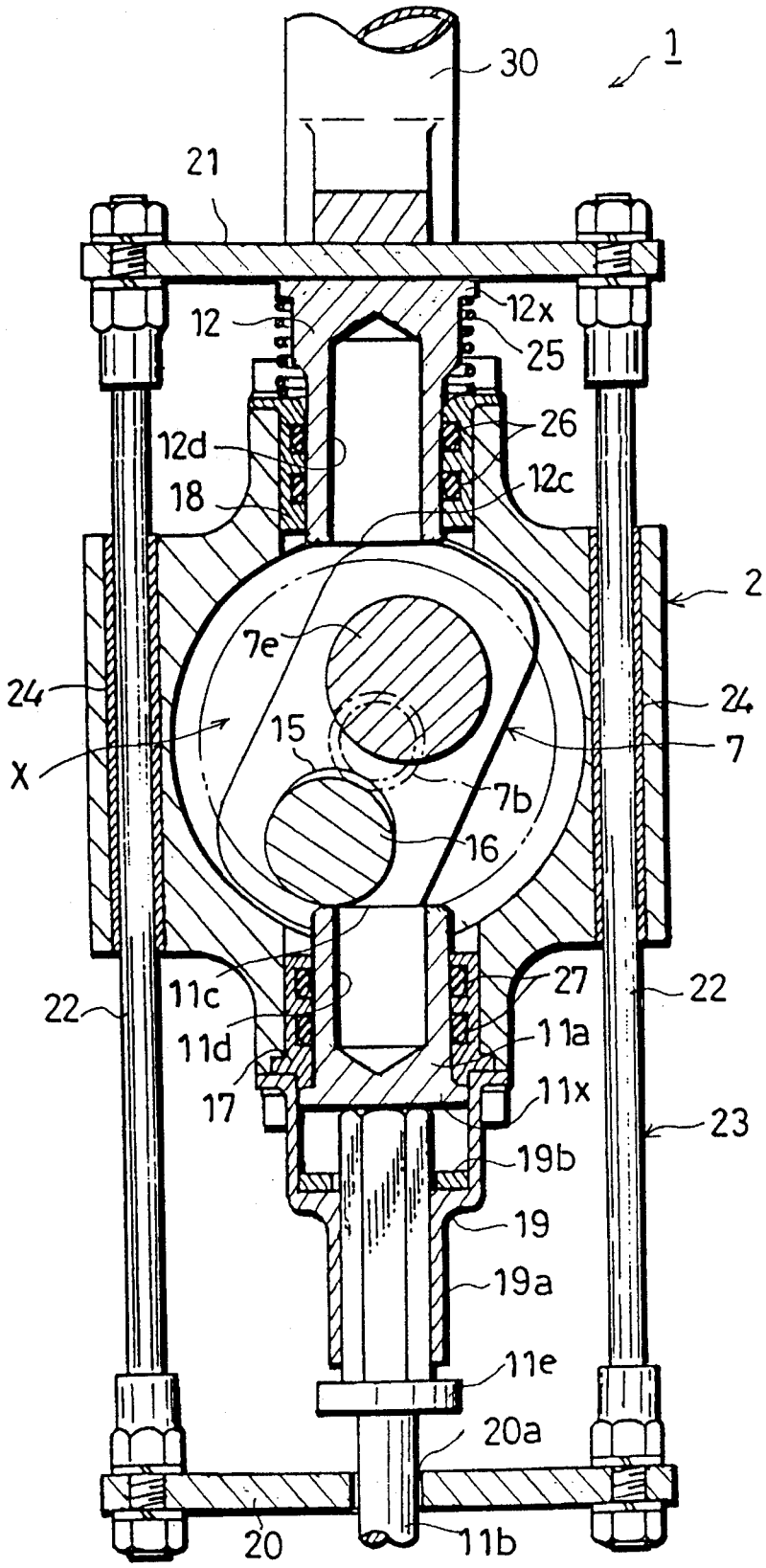
FIG. 7 is a sectional front view similar to FIG. 3 but showing the rotary impacting apparatus of the second embodiment.
Figure 8:
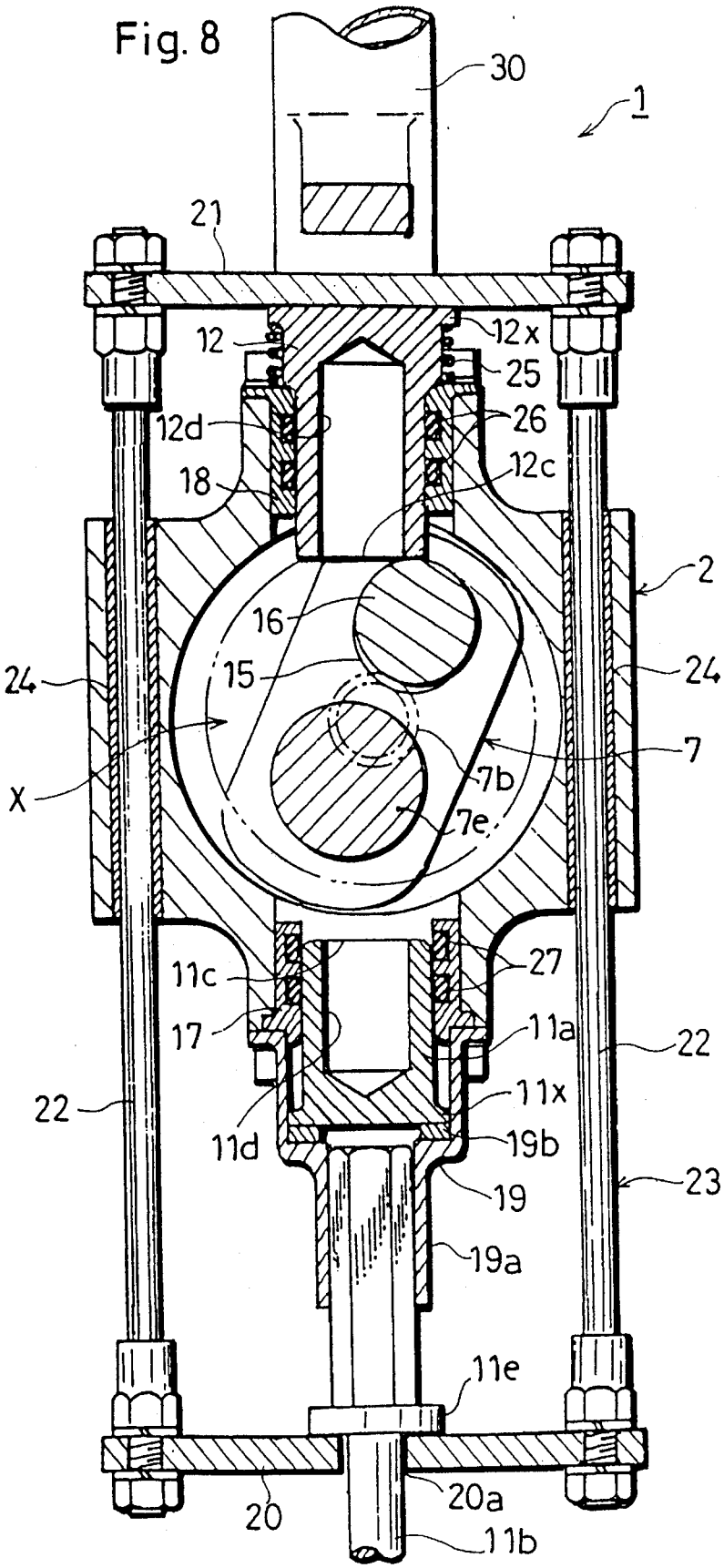
FIG. 8 is a sectional view similar to FIG. 4 but showing the rotary impacting apparatus of the second embodiment.

As shown in FIGS. 5 through 7, the impacting apparatus 1 according to the second embodiment differs mainly from that of the first embodiment in the following points. First, a cover portion 4*x* of the drive source or the engine 4 is connected to the housing 2 by an elongate connecting pipe 30 in which is inserted a rotary transmission shaft 31 for transmitting the rotary output of the driving source 4 to the rotary shaft 7*a* of the rotor 7 in the housing 2. Second, an elastic member 25 for urging the oscillation transmission frame 23 is provided between the enlarged head 12*x* of the auxiliary reciprocative member 12 and the upper end of the housing 2. Third, a limiter 30*x* for limiting the oscillation receiving member 21 from excessive upward movement relative to the housing 2 is fixed to the elongate connecting pipe 30. Fourth, the forward end of the second portion 11*b* of the main reciprocative implement 11 is provided with a blade 11*w* adapted for cutting plants (in particular, for cutting palm leaves) above the ground.

As shown in FIG. 6, the forward end of the rotary transmission shaft 31 carries a drive bevel gear 32 while an end of the rotary shaft 7*a* of the rotor 7 carries a driven bevel gear 33 for engagement with the drive bevel gear 32, making transmission of rotation between the two shafts 7*a* and 31 which are perpendicular to each other. A portion of the rotary transmission shaft 31 near the drive bevel gear 32 is rotatably held by the housing 2 via bearings 34.

Though not shown specifically, the other end (forward end) of the rotary transmission shaft 31 may be connected directly to the output shaft of the engine 4 or splined thereto with a room for a slight axial relative movement if the two shafts are arranged coaxially. If the two shafts are vertical to each other, a pair of bevel gears may be used as described above.

The connecting pipe 30 is provided with two grips 35 adjacent to the engine 4. The grips 35 may be replaced by a grip fixed perpendicularly to the connecting pipe 30. Further, if so desired, a shouldering belt may be additionally provided for the operator to hang the impacting apparatus 1 on his shoulder.

Figure 9:
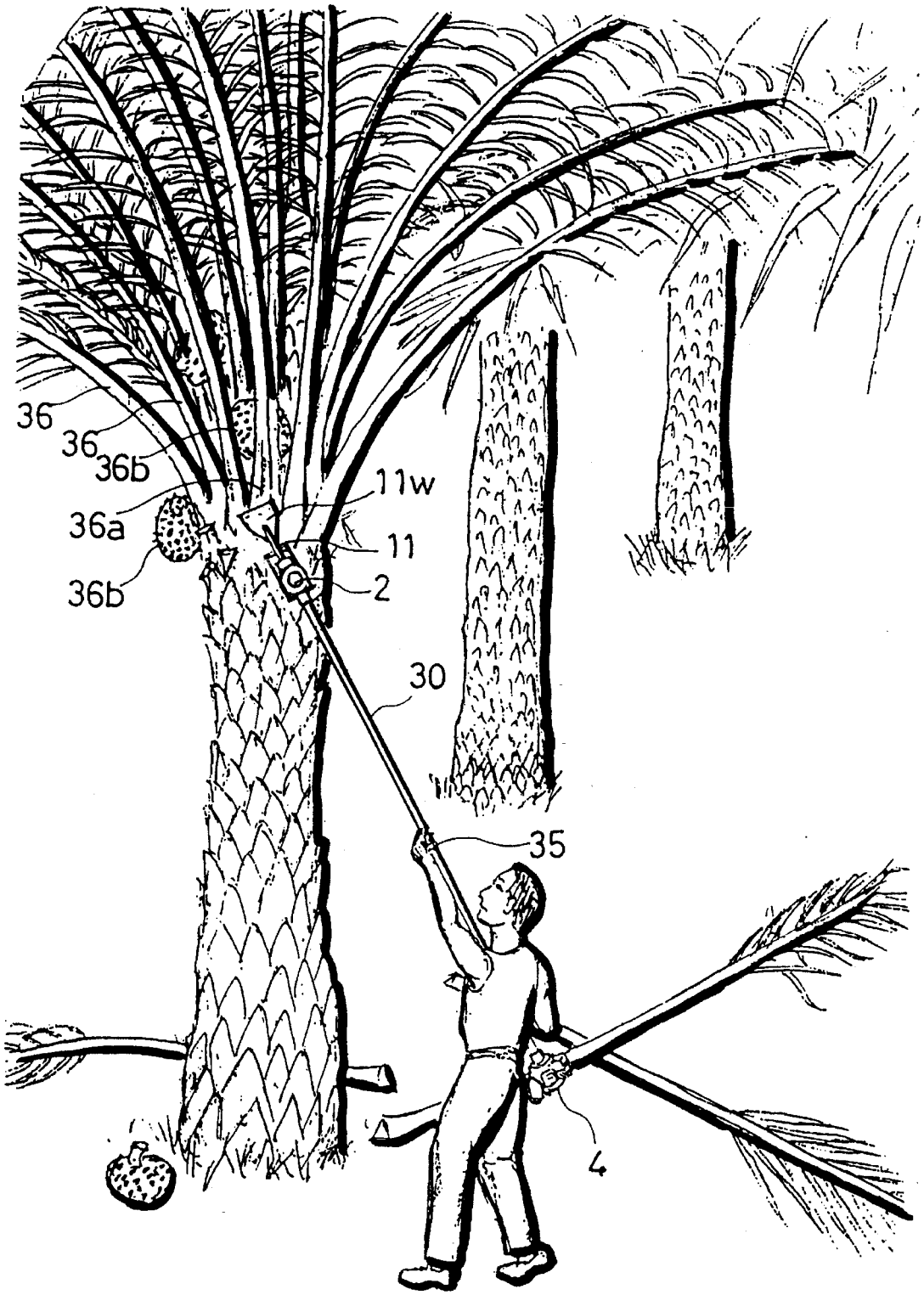
FIG. 9 is a perspective view showing the manner of using the rotary impacting apparatus of the second embodiment.

As shown in FIG. 9, when the rotary impacting apparatus 1 according to the second embodiment is used, the housing 2 and the cutting blade 11*w* are held higher than the engine 4. More specifically, while the rotor 7 of the impacting apparatus 1 is rotated, the operator holds the grips 35 of the connecting pipe 30 and moves the forward end of the pipe 30 upwardly to bring the cutting blade 11*w* against a base portion 36*a* of a palm leaf 36. In this condition, the impact member 16 exerts impacting force and vibration for driving the main reciprocative implement in upwardly, allowing the cutting blade 11*w* to cut the leaf 36. At this time, the impacting apparatus 1 assumes the state shown in FIG. 7, and the impact member 16 together with the main reciprocative implement 11 acting in the same way as in the first embodiment.

Figure 17:
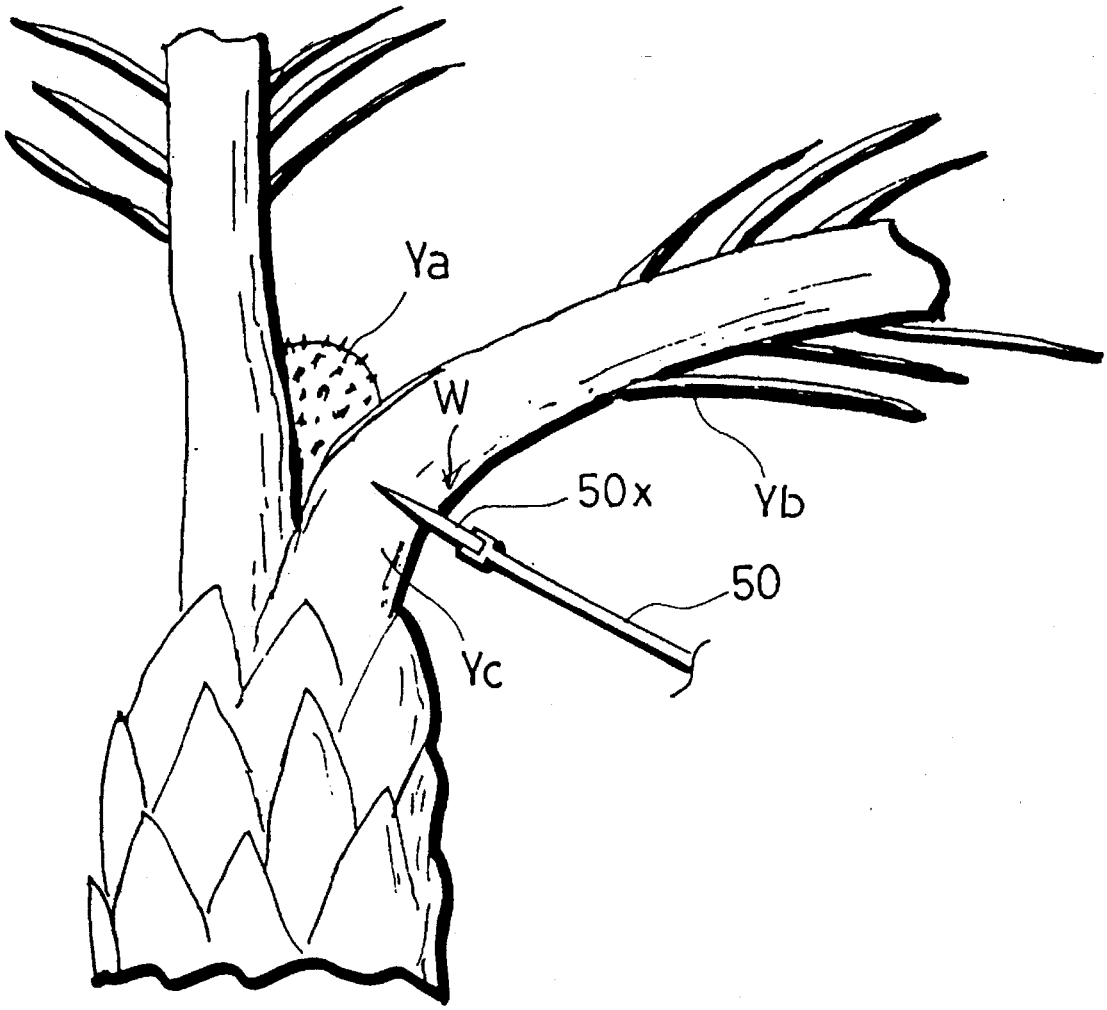
Fig. 17 Prior Art
FIG. 17 is an enlarged perspective view showing the problem conventionally encountered.

When the cutting blade 11*w* is caught by the base portion 36*a* of the leave 36 (see FIG. 17) to the extent that the cutting of the leaf 36 is no longer possible, the operator pulls the connecting pipe 30, thereby exerting a downward pull to the housing 2. Then, the impacting apparatus 1 assumes the state shown in FIG. 8, and the impact member 16 now exerts oscillation to the oscillation receiving member 21 through the auxiliary reciprocative member 12. The oscillation imparting member 20 then transmits the oscillation to the main reciprocative implement in the pulling direction, thereby making it easier to pull the cutting blade 11*w* from the leaf 36.

By repeating the above pressing and pulling operations, the leaf 36 can be cut off at its base portion. After removing a plurality of leaves 36, it becomes much easier to drop the coconut 36*b* by cutting. Of course, it is possible to use the impacting apparatus to drop the coconut 36*b*.

Figure 10:
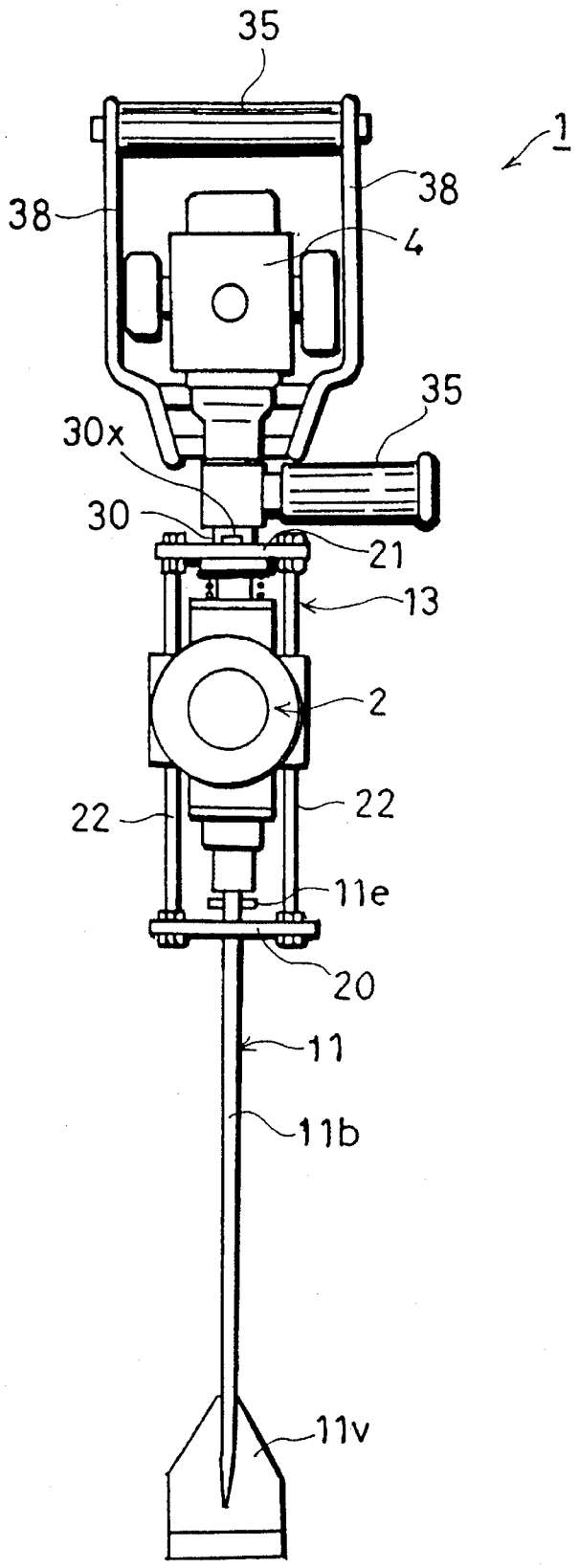
FIG. 10 is a front view showing a rotary impacting apparatus according to a third embodiment of the present invention.

FIG. 10 shows a third embodiment of the rotary impacting apparatus according to the present invention. Since the housing 2 and auxiliary oscillation transmission mechanism 13 of the third embodiment have exactly the same constitution as those of the second embodiment, their details are not shown nor described.

The rotary impacting apparatus of the third embodiment differs from that of the second embodiment in two points. First, in that the connecting pipe 30 between the housing 2 and the engine 4 is much shorter than that of the second embodiment. Secondly, one of the grips 35 is mounted to connect between the upper ends of respective arms 38 supporting the engine 4, whereas the other grip 35 is mounted perpendicularly to the connecting pipe 30.

Figure 11:
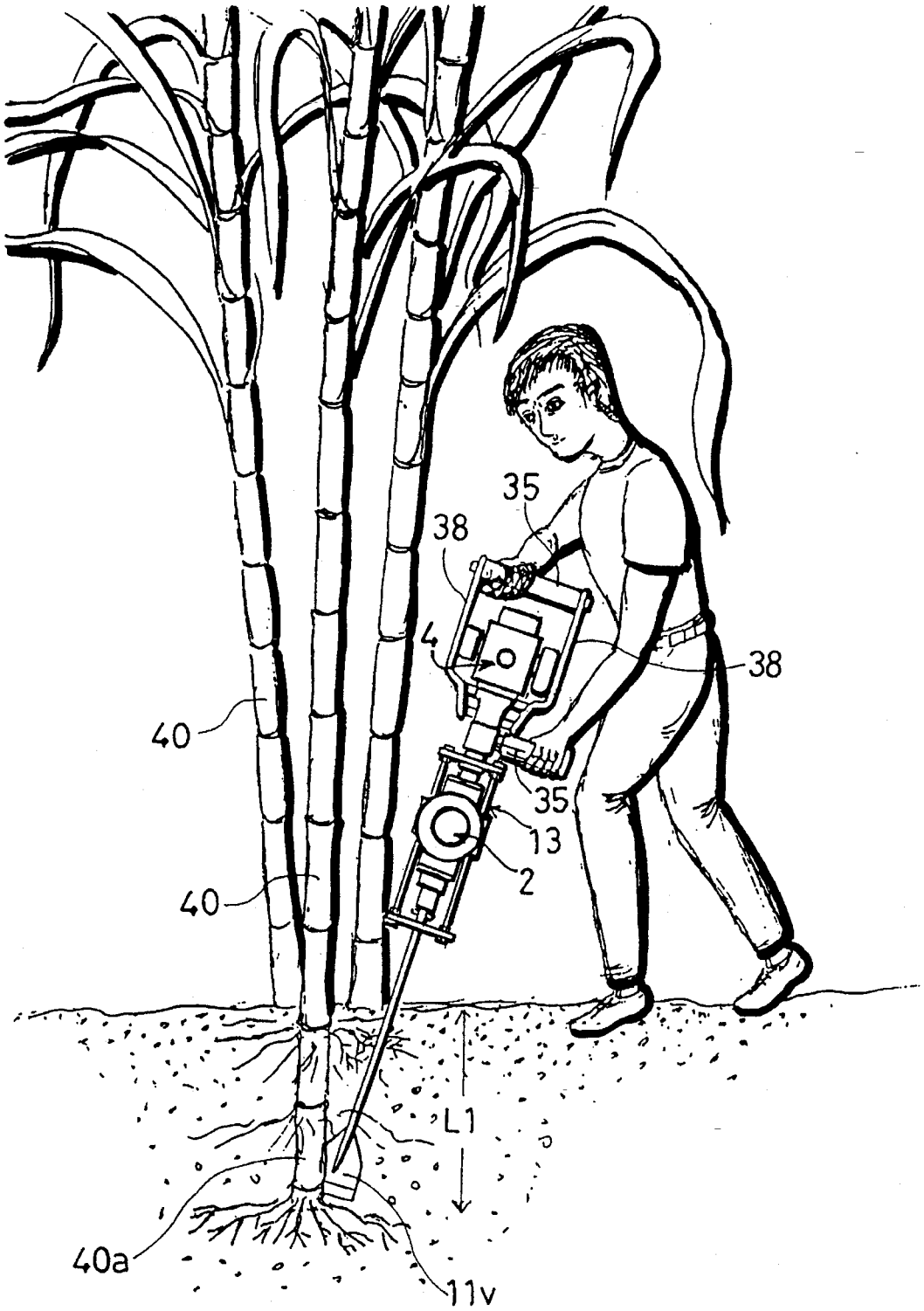
FIG. 11 is a perspective view showing how to use the rotary impacting apparatus of the third embodiment.

The rotary impacting apparatus 1 of the third embodiment may be conveninently used for digging out a base portion 40*a* of sugarcane 40 for instance, as shown in FIG. 11. As is known, since sugarcane 40 has a high sugar content in its base portion 4O*a*, the driving depth L1 for the cutting blade 11*v* of the main reciprocative implement 11 need be 20 cm to 30 cm from the ground surface for harvesting the sugarcane base portion. The impacting apparatus 1 of the third embodiment has been found be advantageously applicable for meeting such a need.

FIGS. 12 through 15 show a rotary impacting apparatus 1 according to a fourth embodiment which can be suitably used for driving or removing a dog nail or other type of nail.

Figure 12:
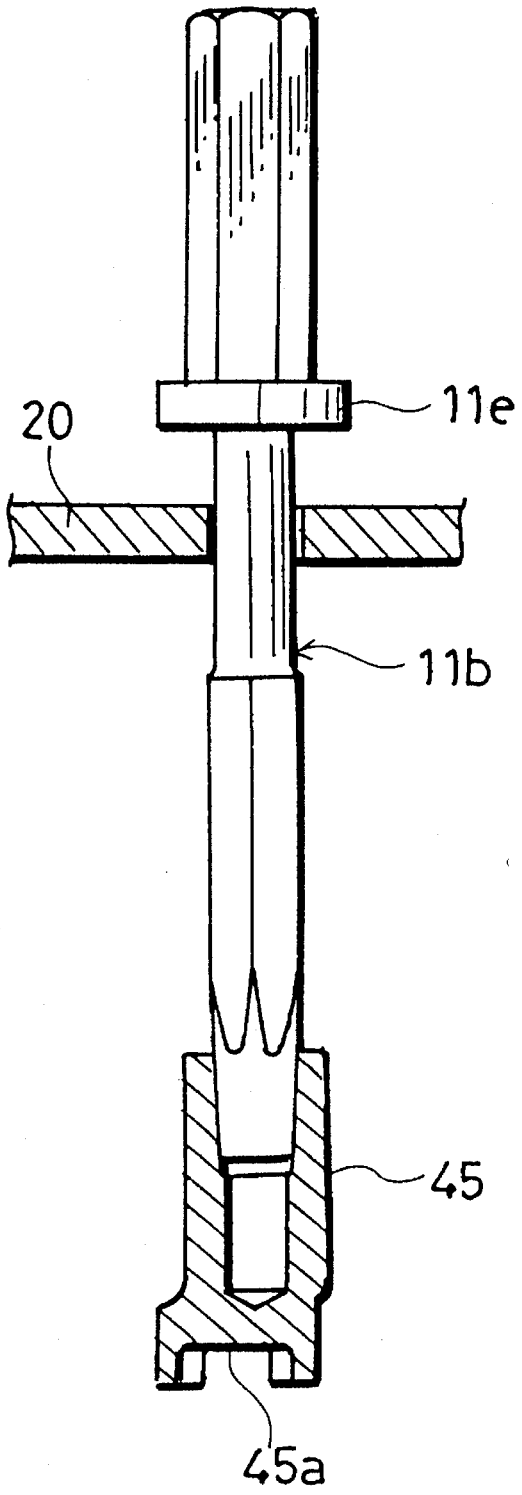
FIG. 12 is a fragmentary front view, in vertical section, showing a principal portion of a rotary impacting apparatus according to a fourth embodiment of the present invention.
Figure 13:
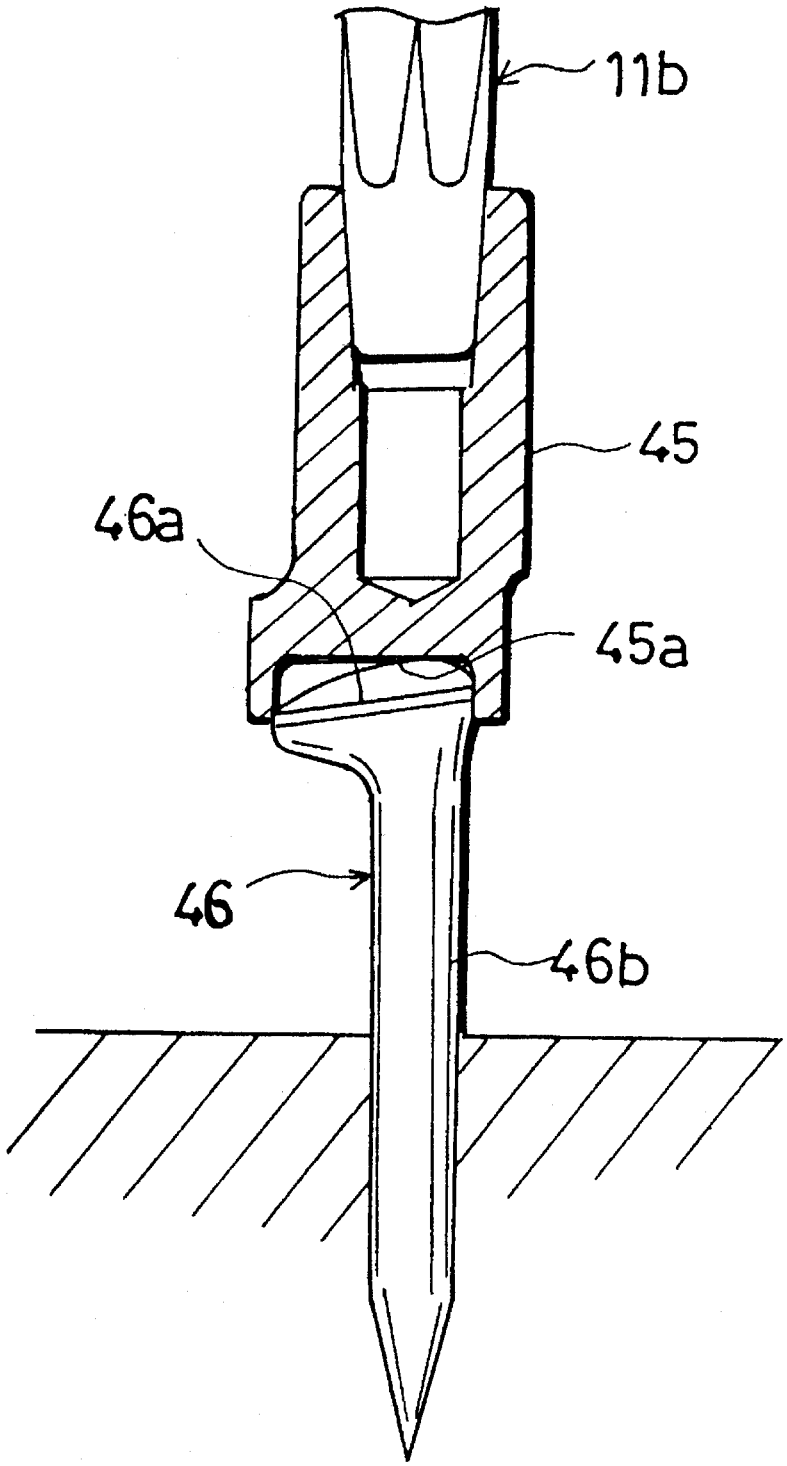
FIG. 13 is a fragmentary front view, in vertical section, showing how to use the rotary impacting apparatus of the fourth embodiment for driving a dog nail.

As shown in FIGS. 12 and 13, according to the fourth embodiment, the lower end 11*b* of the main reciprocative implement 11 is provided with a dog nail driver 45 in place of a root cutting blade. The dog nail driver 45 is formed, at its forward end, with a fitting recess 45*a* for receiving the head 46*a* of a dog nail 46.

Figure 14:
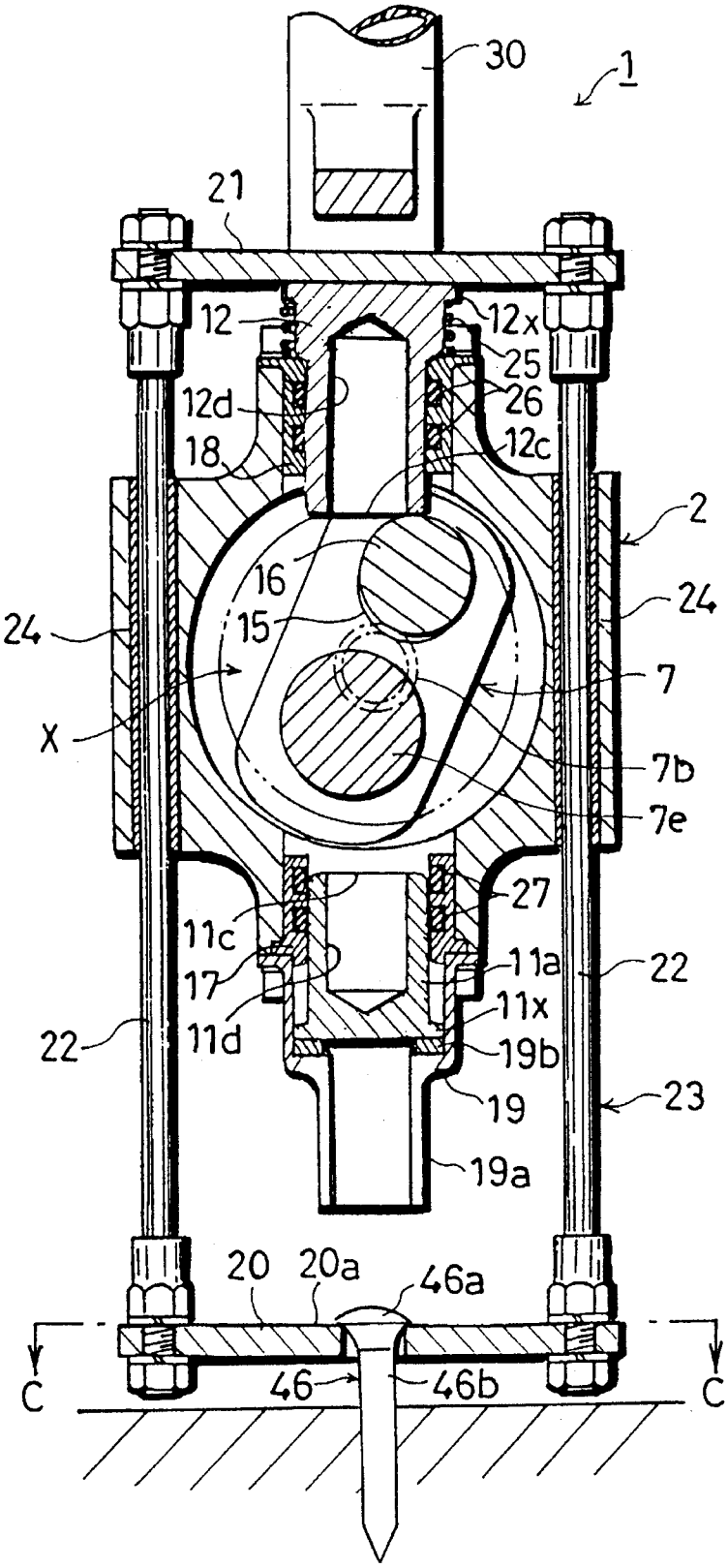
FIG. 14 is an enlarged front view, in vertical section, showing the rotary impacting apparatus of the fourth embodiment for pulling out the dog nail.

On the other hand, when the impacting apparatus according to the fourth embodiment is used for removing the dog nail 46, the second portion 11*b* of the main reciprocative implement 11 is removed, as shown in FIG. 14. Then, the head portion 46*a* of the dog nail 46 is engaged by the top face 20*a* of the oscillation imparting member 20, and the housing 2 is pulled upward. As a result, the impact member 16 upwardly impacts the auxiliary reciprocative member 12 to oscillate the oscillation transmission frame 23, thereby removing the dog nail very easily.

Figure 15:
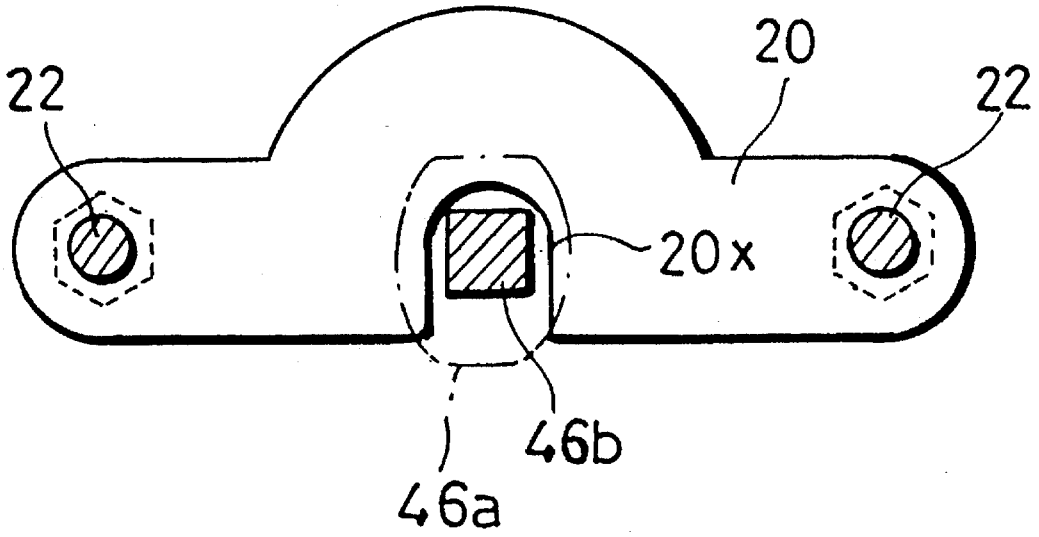
FIG. 15 is a sectional plan view taken along lines C—C of FIG. 14.
Figure 16:
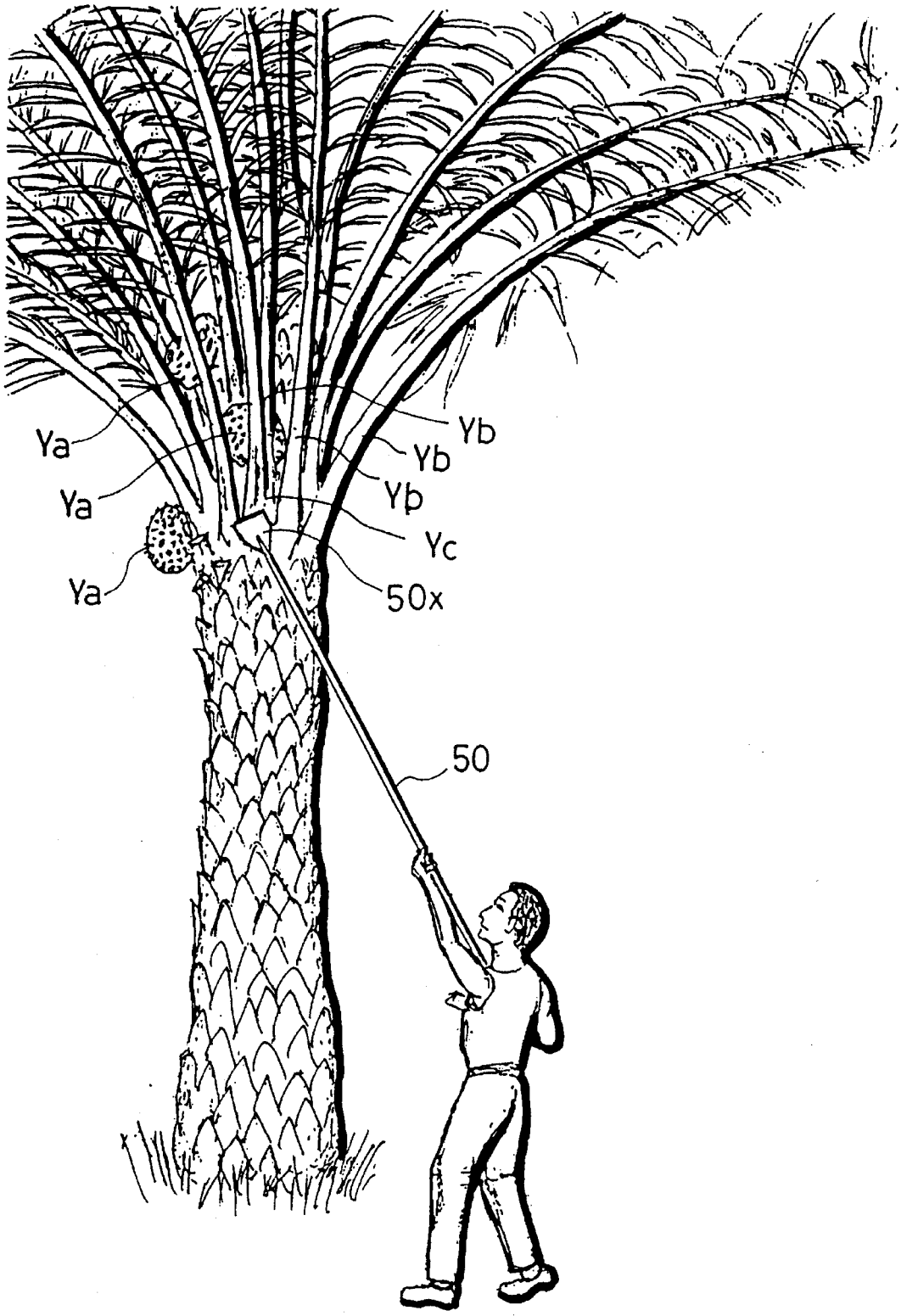
Fig. 16 Prior Art
FIG. 16 is a perspective view showing a conventional method of harvesting coconuts.

In the fourth embodiment, it is desirable, as shown in FIG. 15, to form a cutout 20*x* at a portion of the oscillation imparting member 20 for loosely holding the second portion 11*b* of the main reciprocative implement 11. Such an arrangement allows the shank portion 46*b* of the dog nail 46 to be received in the cutout 20*x* while also allowing the nail head 46*a* to come into engagement with the oscillation imparting member 20, thereby facilitating the nail removal. However, the cutout 20*x* may not be necessarily formed for the nail removal, but instead the head 46*a* of the dog nail 46 may simply be engaged with an edge of the oscillation imparting member 20.

When the first and second portions 11*a*, 11*b* of the main reciprocative implement 11 are formed integrally, the both portions 11*a* and 11*b* must be removed for the nail removing operation.

I claim:

1. A rotary impacting apparatus comprising: a housing; a rotor rotated in the housing by a driving source; an impact member eccentrically held by the rotor; and a main reciprocative implement held reciprocatively at a forward end portion of the housing; the impact member exerting an impacting force for pressing the main reciprocative implement when the housing is advanced relative to the main reciprocative implement;

wherein the rotary impacting apparatus further includes an auxiliary oscillating mechanism for transmitting an impacting force from the impact member to pull the main reciprocative implement when the housing is pulled relative to the main reciprocative implement by a predetermined distance.

2. The rotary impacting apparatus according to claim 1, wherein the auxiliary oscillating mechanism includes: an auxiliary reciprocative member reciprocatively held at a rear end portion of the housing for receiving the impacting force from the impact member when the housing is pulled relative to the main reciprocative implement by the predetermined distance; an oscillation receiving member provided close to the auxiliary reciprocative member for engagement therewith when the housing is pulled relative to the main reciprocative implement by the predetermined distance; an oscillation imparting member for engagement with the main reciprocative implement when the housing is pulled relative to the main reciprocative implement by the predetermined distance; connecting means connecting the oscillation receiving member and the oscillation imparting member; and elastic means urging the oscillation receiving member away from the auxiliary reciprocative member.

3. The rotary impacting apparatus according to claim 2, wherein the connecting means, together with the oscillation receiving member and the oscillation imparting member forms a rectangular frame.

4. The rotary impacting apparatus according to claim 2, wherein the main reciprocative implement is formed with a stopper portion for abutment with the oscillation imparting member when the housing is pulled relative to the main reciprocating implement by the predetermined distance against the elastic means.

5. The rotary impacting apparatus according to claim 1, wherein the main reciprocating implement has a forward end portion provided with a root cutting blade.

6. The rotary impacting apparatus according to claim 1, further including an elongate connecting pipe for connecting the driving source to the housing, a rotary transmission shaft inserted through the connecting pipe for transmitting an output of the driving source to the rotor.

7. The rotary impacting apparatus according to claim 6, wherein the connecting pipe is provided with at least one grip.

8. The rotary impacting apparatus according to claim 6, wherein the main reciprocating implement has a forward end portion provided with a plant cutting blade for cutting a portion of plant above the ground level.

* * * * *